US012690735B2

(12) United States Patent
Dai

(10) Patent No.: US 12,690,735 B2
(45) Date of Patent: Jul. 28, 2026

(54) SURFACE CLEANER

(71) Applicant: BISSELL Inc., Grand Rapids, MI (US)

(72) Inventor: Peter Dai, Suzhou City (CN)

(73) Assignee: BISSELL Inc., Grand Rapids, MI (US)

( * ) Notice: Subject to any disclaimer, the term of this patent is extended or adjusted under 35 U.S.C. 154(b) by 287 days.

(21) Appl. No.: 18/391,923

(22) Filed: Dec. 21, 2023

(65) Prior Publication Data

US 2025/0204735 A1 Jun. 26, 2025

(51) Int. Cl.

| | |
|---|---|
| ***A47L 9/08*** | (2006.01) |
| ***A47L 7/02*** | (2006.01) |
| ***A47L 9/04*** | (2006.01) |
| ***A47L 9/22*** | (2006.01) |
| ***A47L 9/24*** | (2006.01) |
| ***A47L 11/30*** | (2006.01) |
| ***A47L 11/34*** | (2006.01) |
| ***A47L 11/40*** | (2006.01) |

(52) U.S. Cl.

CPC ..... *A47L 9/08* (2013.01); *A47L 9/0411* (2013.01); *A47L 9/0444* (2013.01); *A47L 9/0455* (2013.01); *A47L 9/0477* (2013.01); *A47L 9/22* (2013.01); *A47L 9/248* (2013.01); *A47L 11/4041* (2013.01); *A47L 11/4069* (2013.01)

(58) Field of Classification Search

CPC ..... A47L 7/02; A47L 9/0477; A47L 9/248; A47L 11/34; A47L 11/302; A47L 9/0411; A47L 11/4016; A47L 11/4038; A47L 11/4041; A47L 11/4069; A47L 9/02; A47L 9/04; A47L 9/08; A47L 9/0444; A47L 9/0455; A47L 9/0466; A47L 9/22

See application file for complete search history.

(56) References Cited

U.S. PATENT DOCUMENTS

2021/0045597 A1 2/2021 Kim et al.
2023/0363612 A1 11/2023 DeJonge et al.

FOREIGN PATENT DOCUMENTS

CN 101816535 A 9/2010
CN 106943081 A 7/2017

(Continued)

OTHER PUBLICATIONS

Machine Translation of EP4298970 A1 [retrieved on Mar. 4, 2026]. Retrieved from: Espacenet. (Year: 2026).*

(Continued)

*Primary Examiner* — Eric J Zamora Alvarez
(74) *Attorney, Agent, or Firm* — Quinn IP Law

(57) ABSTRACT

A surface cleaner includes a base housing assembly defining an agitator chamber, and includes an end cap, a bearing disposed axially adjacent to the end cap, and an agitator rotatably supported on the bearing for rotation about an axis of rotation in the agitator chamber. The end cap and the agitator define an axial gap between an axial end of the agitator and the end cap. The surface cleaner includes a motor shaft spaced apart from the agitator, a drive belt operatively connecting the motor shaft and the agitator, and a motor connected with the motor shaft and operable to rotatably drive the agitator via the motor shaft and drive belt. The surface cleaner includes an impeller blower mounted on the motor shaft, and a conduit system at least partially defining an air channel directing air blown by the impeller blower into the axial gap.

20 Claims, 13 Drawing Sheets

(56) References Cited

FOREIGN PATENT DOCUMENTS

| | | | |
|---|---|---|---|
| CN | 206534594 | U | 10/2017 |
| CN | 108403000 | A | 8/2018 |
| CN | 112515559 | A | 3/2021 |
| CN | 114847793 | A | 8/2022 |
| DE | 102019104663 | A1 | 8/2020 |
| EP | 4298970 | A1 | 1/2024 |
| JP | H0951865 | A | 2/1997 |
| JP | 2002165733 | A | 6/2002 |
| JP | 5923681 | B2 | 5/2016 |

OTHER PUBLICATIONS

Machine Translation of CN114847793 A [retrieved on Mar. 4, 2026]. Retrieved from: Espacenet. (Year: 2026).*

* cited by examiner 250
70
66B
66
66A
257
261
257
54
261
A
96B
123B
58
123B
50
96B
A
A
A

SURFACE CLEANER

TECHNICAL FIELD

The present disclosure generally relates to a surface cleaner for cleaning a surface.

BACKGROUND

There are many types of surface cleaners, some of which may employ suction and/or a fluid to clean a surface. One category of surface cleaner is referred to as an upright cleaner. Some surface cleaners, including some upright cleaners, may be extraction cleaners that extract dirt from a surface using both a vacuum system to suction debris and/or fluid from a surface and a fluid delivery system.

BRIEF SUMMARY

A surface cleaner with various improvements is disclosed herein. The surface cleaner may be, but is not limited to, an upright extraction cleaner. The surface cleaner is configured to blow air into an axial gap between an agitator, such as a brush roll, and an end cap on which the agitator is rotatably supported by a bearing. The blown air inhibits debris from settling in the gap. For example, the blown air may prevent hair picked up from the cleaning surface by suction of the surface cleaner from being tangled at the end cap and/or the bearing.

A surface cleaner configured for movement across a surface to be cleaned includes a base housing assembly defining an agitator chamber, and includes an end cap. The surface cleaner may also include a bearing disposed axially adjacent to the end cap and an agitator rotatably supported on the bearing for rotation about an axis of rotation in the agitator chamber. In a nonlimiting example, the agitator may be a brush roll. The end cap and the agitator may define an axial gap between an axial end of the agitator and the end cap. The surface cleaner may also include a motor shaft spaced apart from the agitator, a drive belt operatively connecting the motor shaft and the agitator, and a motor connected with the motor shaft and operable to rotatably drive the agitator via the motor shaft and drive belt. The surface cleaner may include an impeller blower mounted on the motor shaft, and a conduit system at least partially defining an air channel directing air blown by the impeller blower into the axial gap.

Accordingly, the surface cleaner is configured to inhibit debris, such as hair, from settling in the axial gap. This may prevent hair picked up by suction of the surface cleaner from becoming tangled at the end cap and bearing. By mounting the impeller motor on the same motor shaft as the motor that drives the agitator, a reduction in parts and necessary packaging space may be realized in comparison to a system with a separate motor and motor shaft for the impeller blower.

In an example, the end cap may define at least one opening extending therethrough. The air channel directs air through the at least one opening toward the bearing and the axial gap. In some implementations, an outlet of the at least one opening in the end cap may be disposed such that the air blown into the axial gap is directed at least partially at an axial end face of the bearing. For example, the at least one opening may extend parallel to the axis of rotation of the agitator through an axial wall of the end cap. By directing the air in this manner, the blown air may be more effective at preventing hair and other collected debris from lodging in or around the end cap and bearing.

In some implementations, the blown air may be further directed to continue past the axial gap and out through an opening in the agitator. For example, the surface cleaner may further include a bearing holder surrounding an outer race of the bearing and disposed between the outer race and an inner surface of the agitator. The agitator may define an opening extending from the inner surface to an exterior surface of the agitator. The bearing holder may define an air channel extension, an inlet to the air channel extension at the axial gap, and an outlet of the air channel extension in fluid communication with the opening in the agitator to expel the blown air from the gap.

In one implementation of such a configuration, the inlet of the bearing holder may be disposed perpendicular to the outlet of the bearing holder. In the same implementation or in a different implementation, the outlet of the bearing holder may be a first outlet, the opening in the agitator may be a first opening, and the bearing holder may further define a second outlet of the air channel extension. The agitator may define a second opening extending from the inner surface to the exterior surface of the agitator. The first outlet and the first opening may be disposed axially adjacent a first edge of the drive belt. The second outlet and the second opening may be disposed axially adjacent a second edge of the drive belt. In this manner, in addition to inhibiting debris in the axial gap between the end of the agitator and the bearing, the blown air is directed at either side of the drive belt through the first and second openings in the agitator. Because the drive belt is typically protected by ribs extending next to the first and second edges of the drive belt, the air blown through the first and second openings may further prevent hair and debris from entering small gaps between the ribs and the pulley and becoming entangled with the drive belt.

In one implementation, the bearing holder may have an annular extension extending axially within a center cavity of the agitator away from the end cap and the bearing. The annular extension may define the air channel extension.

In some implementations, the agitator itself may be configured to help direct the blown air. For example, a bearing holder may surround an outer race of the bearing and may be disposed between the outer race and an inner surface of the agitator. The bearing holder may define a first air channel extension, an inlet to the first air channel extension at the axial gap, and an outlet of the first air channel extension. The agitator may define a second air channel extension, an axial inlet opening of the second air channel extension in fluid communication with the outlet of the first air channel extension defined by the bearing holder, and an outlet of the second air channel extension at an exterior surface of the agitator. For example, the second air channel extension may extend in an axial direction away from the first air channel extension.

In an implementation, the outlet of the second air channel extension defined by the agitator may be a first outlet and the agitator may include a second outlet at the exterior surface of the agitator axially-spaced from the first outlet.

In some implementations, the conduit system may include a flexible tube defining at least a portion of the air channel between the impeller blower and the end cap. In the same implementations or in other implementations, the conduit system may include portions of the base housing assembly that are configured to define at least a portion of the air channel. The base housing assembly may include a first housing member and a second housing member that interfit with one another to together form a portion of the air channel of the conduit system directing air blown by the impeller blower into the axial gap.

In an example, the first housing member may include a first set of ribs and the second housing member may include a second set of ribs. The first set of ribs may interfit with the second set of ribs when the first housing member is interfit with the second housing member to define the portion of the air channel bounded by the first housing member, the second housing member, the first set of ribs, and the second set of ribs. In some implementations, the first set of ribs and the second set of ribs may each only include one rib. For example, the sets of ribs need not form the entire air channel, and may be used with other structure, such as flexible tubes, etc., to form the air channel.

Within the scope of the disclosure, a surface cleaner configured for movement across a surface to be cleaned may include a base housing assembly defining an agitator chamber, and may include an end cap. The end cap may define at least one opening extending therethrough. A bearing may be disposed axially adjacent to the end cap. The agitator may be rotatably supported on the bearing for rotation about an axis of rotation in the agitator chamber. The end cap and the agitator may define an axial gap between an axial end of the agitator and the end cap. The surface cleaner may further include a motor, an impeller blower operatively connected to the motor, and a conduit system at least partially defining an air channel directing air blown by the impeller blower through the at least one opening in the end cap into the axial gap. The at least one opening in the end cap may be configured to direct the blown air at least partially in an axial direction into the axial gap.

In an example, the at least one opening may extend parallel to the axis of rotation of the agitator through an axial wall of the end cap. In other words, the blown air flows in an axial direction through the end cap. Furthermore, the at least one opening may include multiple openings spaced from one another about the axis of rotation. The openings may each be the same shape or may be a variety of shapes, such as circular, square, or sectorial, and may be spaced equidistant from one another or adjacent openings may be at a variety of different spacings from one another.

In an example, the motor driving the impeller blower may be a first motor mounted on a first motor shaft spaced apart from and not drivingly connected to the agitator. The surface cleaner may further include a second motor mounted on a second motor shaft spaced apart from the agitator and a drive belt operatively connecting the second motor shaft and the agitator. The second motor may rotatably drive the agitator via the drive belt. Such an implementation including two motors on different motor shafts enables the impeller blower to be rotated at a different speed than the agitator. Additionally, the first motor may be controlled separately from the second motor such that it need not necessarily be powered to drive the impeller blower at all times that the second motor is rotatably driving the agitator. For example, the impeller blower might be pulsed to blow air into the axial gap at discreet time intervals when the second motor is driving the agitator.

Within the scope of the disclosure, a surface cleaner configured for movement across a surface to be cleaned may include a base housing assembly defining an agitator chamber, and may include an end cap. The end cap may define at least one opening extending therethrough. The surface cleaner may further include a bearing disposed axially adjacent to the end cap and an agitator rotatably supported on the bearing for rotation about an axis of rotation in the agitator chamber. The end cap and the agitator may define an axial gap between an axial end of the agitator and the end cap. The surface cleaner may further include an impeller blower and a motor operatively connected to the impeller blower and operable to rotatably drive the impeller blower. The surface cleaner may include a conduit system at least partially defining an air channel directing air blown by the impeller blower through the opening in the end cap into the axial gap. The surface cleaner may include a bearing holder surrounding an outer race of the bearing and disposed between the outer race and an inner surface of the agitator. The conduit system may define an air channel extension extending at least partially axially within the agitator with an outlet at an exterior surface of the agitator. In this way, the exiting blown air is moved further from the axial gap. For example, the exiting blown air may be adjacent to a drive belt for the agitator and may further help prevent debris such as hair from becoming entangled at the drive belt.

In some implementations, the bearing holder defines at least a portion of the air channel extension and defines an inlet at the axial gap. In some implementations, the agitator may define an additional air channel extension including an axial inlet in fluid communication with an outlet of the portion of the air channel extension defined by the bearing holder. For example, the additional portion of the air channel extension may extend from the axial inlet opening to the opening extending through the agitator.

BRIEF DESCRIPTION OF THE DRAWINGS

The drawings described herein are for illustrative purposes only, are schematic in nature, and are intended to be exemplary rather than to limit the scope of the disclosure.

The above features and advantages and other features and advantages of the present teachings are readily apparent from the following detailed description of the modes for carrying out the present teachings when taken in connection with the accompanying drawings. It should be understood that even though in the following Figures embodiments may be separately described, single features thereof may be combined to additional embodiments.

DETAILED DESCRIPTION

Figure 1:
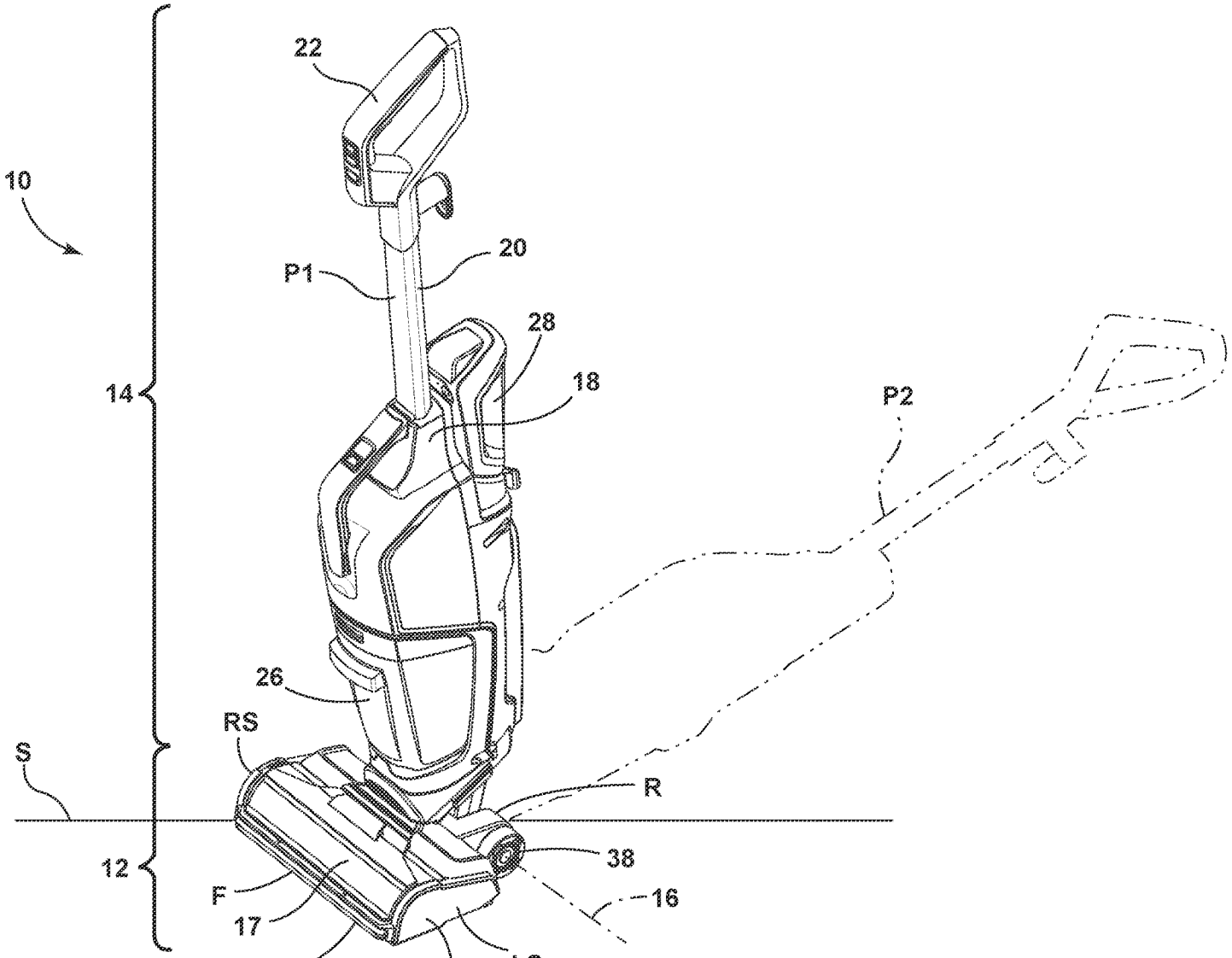
FIG. 1 is a plan view of one example of a surface cleaner with a base and a spine assembly, showing the spine assembly in an upright position and showing a reclined position in phantom.

The present disclosure generally relates to a surface cleaner 10, such as shown in FIG. 1, and various aspects thereof for improved performance, compactness, ease of use, and other benefits. Most specifically, the surface cleaner 10 may include features that inhibit hair and other debris picked up in the working air stream from lodging in and around the agitator assembly, such as in an axial gap between an end cap and a bearing for an agitator. Such locations may be difficult for an operator to clean and, as such, the features disclosed herein may ensure optimal performance of the surface cleaner 10.

The surface cleaner 10 includes a base 12 and a spine assembly 14 pivotably connected to the base 12 and pivotable about a pivot axis 16 between a first position P1 and a second position P2. The first position P1 is also referred to as an upright position or a storage position and is shown in FIG. 1. The second position P2 is also referred to as a use position or a reclined position, and is shown in phantom in FIG. 1, in which the spine assembly 14 is pivoted rearwardly relative to the upright position.

The surface S may be, for example, any type of flooring, including soft surfaces, such as carpet and rugs, and hard surfaces, such as tile, wood, vinyl, and laminate surfaces. According to some aspects, the surface cleaner 10 may be in the form of an upright deep cleaner, also referred to as an extraction cleaner, which is configured for use on soft flooring surfaces, such as carpets and rugs. However, the aspects disclosed herein may be implemented on other types and configurations of cleaning apparatuses within the scope of the disclosure. The surface cleaner 10 can comprise various systems and components including a dual-phase fluid delivery system, a liquid delivery system, and a recovery system. These various systems and components can be supported by either or both of the base 12 and the spine assembly 14.

For purposes of description related to the figures, the terms "upper," "lower," "right," "left," "rear," "front," "vertical," "horizontal," "inner," "outer," and derivatives thereof shall relate to the disclosure as oriented in FIG. 1 from the perspective of a user behind the surface cleaner 10 (e.g., to the right of the surface cleaner 10 in FIG. 1), which defines the rear R of the surface cleaner 10. However, it is to be understood that the disclosure may assume various alternative orientations, except where expressly specified to the contrary. The front F of the surface cleaner 10 is also indicated in FIG. 1 and is at a nozzle 17. A left side LS of the surface cleaner 10 is indicated in FIG. 1, as is a right side RS.

The spine assembly 14 may include a frame 18 and can include any type of handle 20, wand, body, or combination thereof suitable for the purposes described herein, including for a user to maneuver the surface cleaner 10 over the surface S to be cleaned. The handle 20 extends upwardly from the frame 18 and is provided with a hand grip 22 at one end that can be used for maneuvering the surface cleaner 10 over the surface S to be cleaned.

The frame 18 is a main support section (also referred to as a spine) supporting components of the surface cleaner 10, including, but not limited to, a recovery tank 26 for recovering dirty fluid and that is part of a recovery system, and a supply tank 28 for supplying cleaning fluid and that is part of a liquid delivery system. An accessory hose port may be in fluid communication with the recovery system in an upper portion of the suction nozzle 17 for selectively coupling with an accessory hose (not shown) to which cleaning tools may be attached.

A suction source, such as a motor/impeller system, may be positioned in the base 12 or in a lower part of the frame 18 in fluid communication with the suction nozzle 17 and the recovery tank 26. The nozzle 17 defines a nozzle inlet 29 through which a vacuum is created by a suction source in fluid communication with the nozzle 17 for generating a working air stream to the recovery tank 26 for separating and collecting fluid and dirt from the working airstream for later disposal.

The recovery system can include the suction nozzle 17, the suction source in fluid communication with the suction nozzle 17 for generating the working air stream, and the recovery tank 26 for separating and collecting fluid and debris from the working airstream for later disposal. Other components of the spine assembly 14 may include, but are not limited to, a heater, pumps, a power source, and the like, or any combination thereof.

The base 12 can comprise any type of base, foot, or cleaning head suitable for the purposes described herein. In one embodiment, the base 12 includes a base housing assembly 36 supporting components of various systems, including, but not limited to a steam dispenser, a liquid dispenser, a suction nozzle, and an agitator. I Wheels 38 can at least partially support the base housing assembly 36 for movement over the surface S to be cleaned.

A moveable joint assembly (not shown) can connect the base 12 to the spine assembly 14 for movement of the spine assembly 14 about the pivot axis 16. Wiring and/or conduits can optionally supply electricity, air, liquid and/or steam between the spine assembly 14 and the base 12, or vice versa, and can extend though the joint assembly. For example, portions of the drive assembly 68 discussed herein may be located in the spine assembly and portions in the base 12. For example, the drive motor 76 may be housed in the spine assembly 14. Portions of the conduit system 40 described herein may thus span a joint between the spine assembly 14 and the base 12. One example of a movable joint assembly is disclosed in U.S. Nonprovisional application Ser. No. 18/307,923, filed Apr. 27, 2023, published as US20230363612, DeJonge et al., which is incorporated herein by reference in its entirety. In the embodiment shown herein, the spine assembly 14 can pivot about the pivot axis 16 relative to the base 12. In some embodiments, a movable joint assembly connecting the base 12 to the spine assembly 14 can alternatively comprise a universal joint, such that the spine assembly 14 can swivel about its longitudinal axis in addition to pivoting relative to the base 12.

Figure 2:
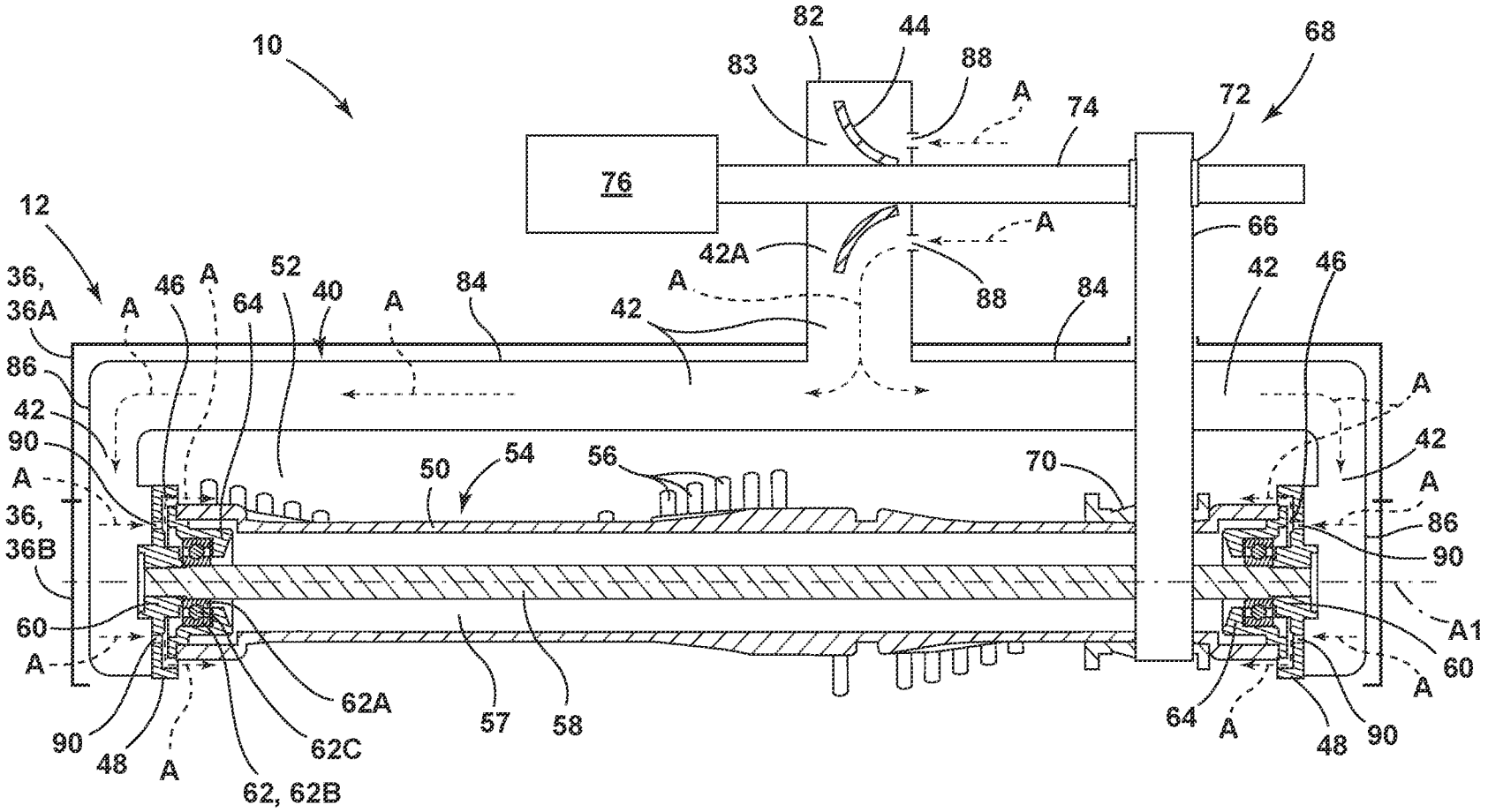
FIG. 2 is a plan view in partial cross section of a portion of the surface cleaner of FIG. 1 showing one example of a conduit system defining an air channel directing air blown by an impeller blower into an axial gap between an end cap and an agitator in the base.

FIG. 2 is a plan view of a portion of the surface cleaner 10 of FIG. 1 showing one example of a conduit system 40 defining an air channel 42 directing air blown by an impeller blower 44 into an axial gap 46 between an end cap 48 and an agitator 50 in the base 12. FIG. 2 schematically represents the base housing assembly 36 and shows that the base housing assembly 36 defines, at least in part, an agitator chamber 52 in which an agitator assembly 54 including the agitator 50 is housed. The base housing assembly 36 may include an upper housing portion 36A and a lower housing portion 36B configured to interfit and/or be secured to one another with screws or the like to together define the agitator chamber 52, for example. The upper housing portion 36A and lower housing portion 36B may also be referred to as an upper cover and a lower cover, respectively.

The nozzle 17 may be secured to a front of the assembled base housing assembly 36. Although only one agitator 50 is shown, multiple agitators may be housed in the base housing assembly 36 and arranged parallel to one another, such as a first or front agitator and a second or rear agitator. The agitator 50 is shown as a brush roll having bristles 56 that act to agitate the surface S during cleaning to loosen dirt and debris. While the agitator 50 is illustrated as a brush roll having rows of bristles, it is within the scope of the present disclosure for the agitator to include additional or alternative configurations, non-limiting examples of which include microfiber material, fabric or polymeric blades, and combinations thereof.

The agitator 50 defines an axis of rotation A1 about which the agitator 50 rotates in the agitator chamber 52. The axis A1 is generally horizontal and parallel to the surface S to be cleaned when the agitator assembly 54 is in use. The agitator 50 defines a central cavity 57 configured as a through hole, as the agitator 50 is open at both ends. The agitator axis A1 is a longitudinal axis of a dowel rod 58 that extends longitudinally in the central cavity 57 and operatively supports the agitator 50. The dowel rod 58 extends with the axis A1 parallel to the front F of the base 12 and extends from the left side LS to the right side RS shown in FIG. 1.

A respective end cap 48 is disposed at each end of the dowel rod 58 and supports the dowel rod 58 at a hub 60 of the end cap 48. A bearing 62 and a bearing holder 64 are also disposed axially inward of the end cap 48 at each end. The end caps 48, dowel rod 58 and an inner race 62A of the bearing 62 are non-rotating while an outer race 62B of the bearing 62 rotatably supports the annular bearing holder 64. Rolling elements 62C are disposed between the inner and outer races 62A, 62B. The outer race 62B, the bearing holder 64, and the agitator 50 are thus rotatable about the axis of rotation A1.

The bearing holder 64 in turn is fixed to and supports an inner surface 65 of the agitator 50 for rotation about the axis A1. Stated differently, the annular bearing holder 64 surrounds and supports an outer circumference of the bearing 62 and is in turn supported at its outer circumference at the ends of the agitator 50 in the cavity 57.

The agitator 50 is driven by a belt 66 of a drive assembly 68 that also includes pulleys 70, 72, a motor shaft 74, and a drive motor 76. The pulley 70 is disposed on and rotates with the agitator 50. The belt 66 is engaged with the pulley 70 near an end of the agitator 50. The pulley 70 rotates with the agitator 50 about the agitator axis A1. A sprocket may be used instead of a pulley 70. The pulley 72 is disposed on and rotates with a motor shaft 74. A sprocket may be used instead of a pulley 72. The belt 66 is also engaged with a pulley 72 on the motor shaft 74 that is disposed parallel with the axis of rotation A1. In an example, the drive motor 76 may be an electric motor and is disposed on and drives the motor shaft 74 and in turn drives the agitator 50.

Figure 8:
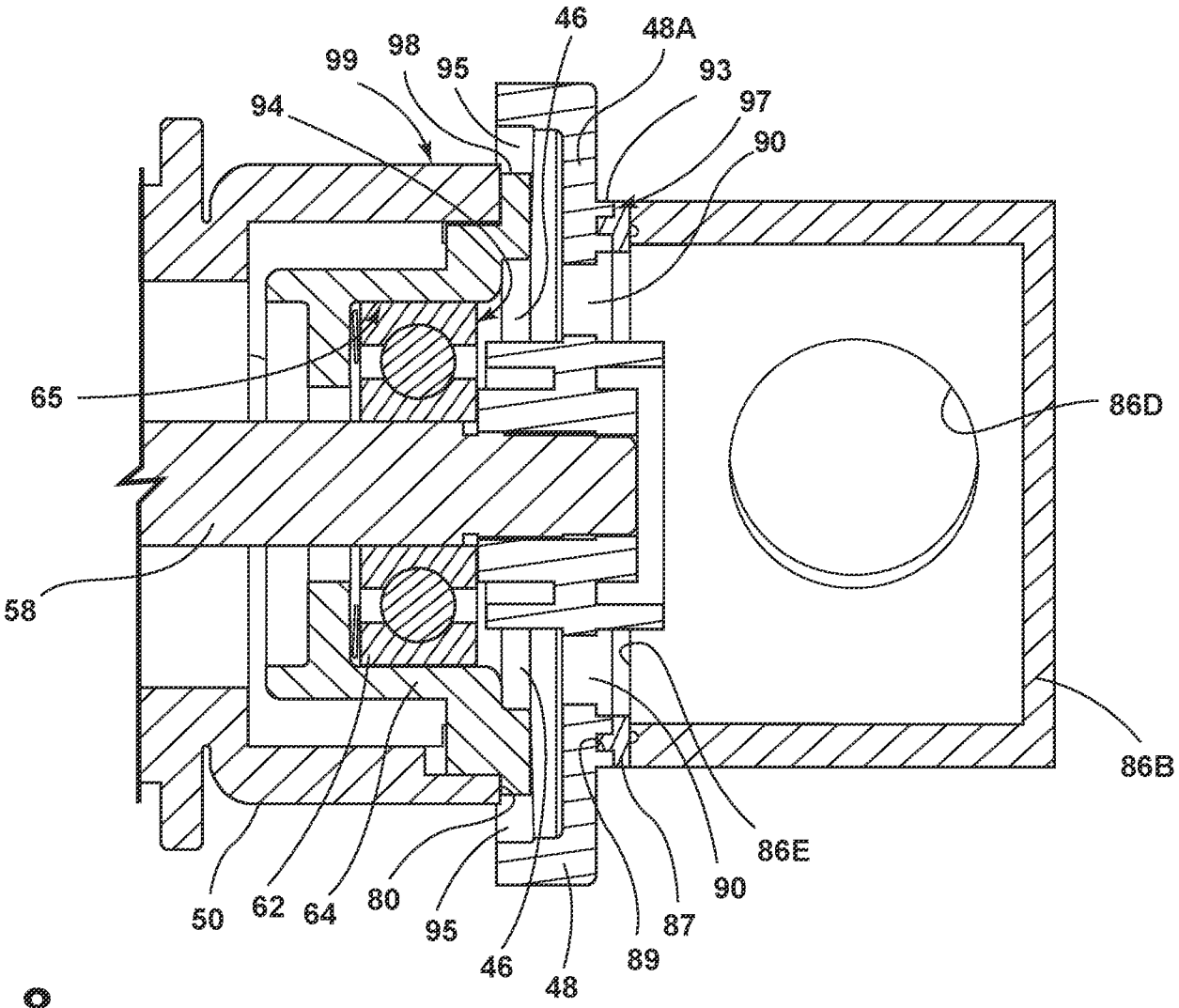
FIG. 8 is a fragmentary cross-sectional view of the surface cleaner taken at lines 8-8 in FIG. 3.

With reference to the enlarged view of FIG. 8, the bearing 62 is disposed axially adjacent to the end cap 48 (e.g., via the annular bearing holder 64). The bearing 62 and end cap 48 at the opposing end of the agitator 50 may be a mirror image of those shown in FIG. 8 and, accordingly, the discussion with respect to FIG. 8 applies equally to the structure at the opposing end of the agitator 50. The agitator 50 is rotatably supported on the bearing 62 for rotation about the axis of rotation A1 in the agitator chamber 52. The end cap 48 and the agitator 50 define the axial gap 46 between an axial end 80 of the agitator 50 and the end cap 48.

With reference again to FIG. 2, the conduit system 40 at least partially defines the air channel 42 directing air blown by the impeller blower 44 into the axial gap 46. The conduit system 40 may include a first segment 82 (best shown in FIGS. 4 and 5) around the impeller blower 44, a second segment 84 extending from the first segment toward opposite ends of the agitator assembly 54, and end segments 86 connecting the second segment 84 to the end caps 48. The second segment 84 is shown extending generally parallel with the axis of rotation A1. Air flow through the air channel 42 of the conduit system 40 is indicated by arrows A, beginning with air at one or more inlets 88 in the first segment 82 (discussed in more detail with respect to FIGS. 4 and 5) pulled in by the impeller blower 44 that is in turn blown by the impeller blower 44 through the second and third segments 84, 86 through one or more openings 90 in each of the end caps 48 (discussed in further detail with respect to FIGS. 6 and 7).

Figure 3:
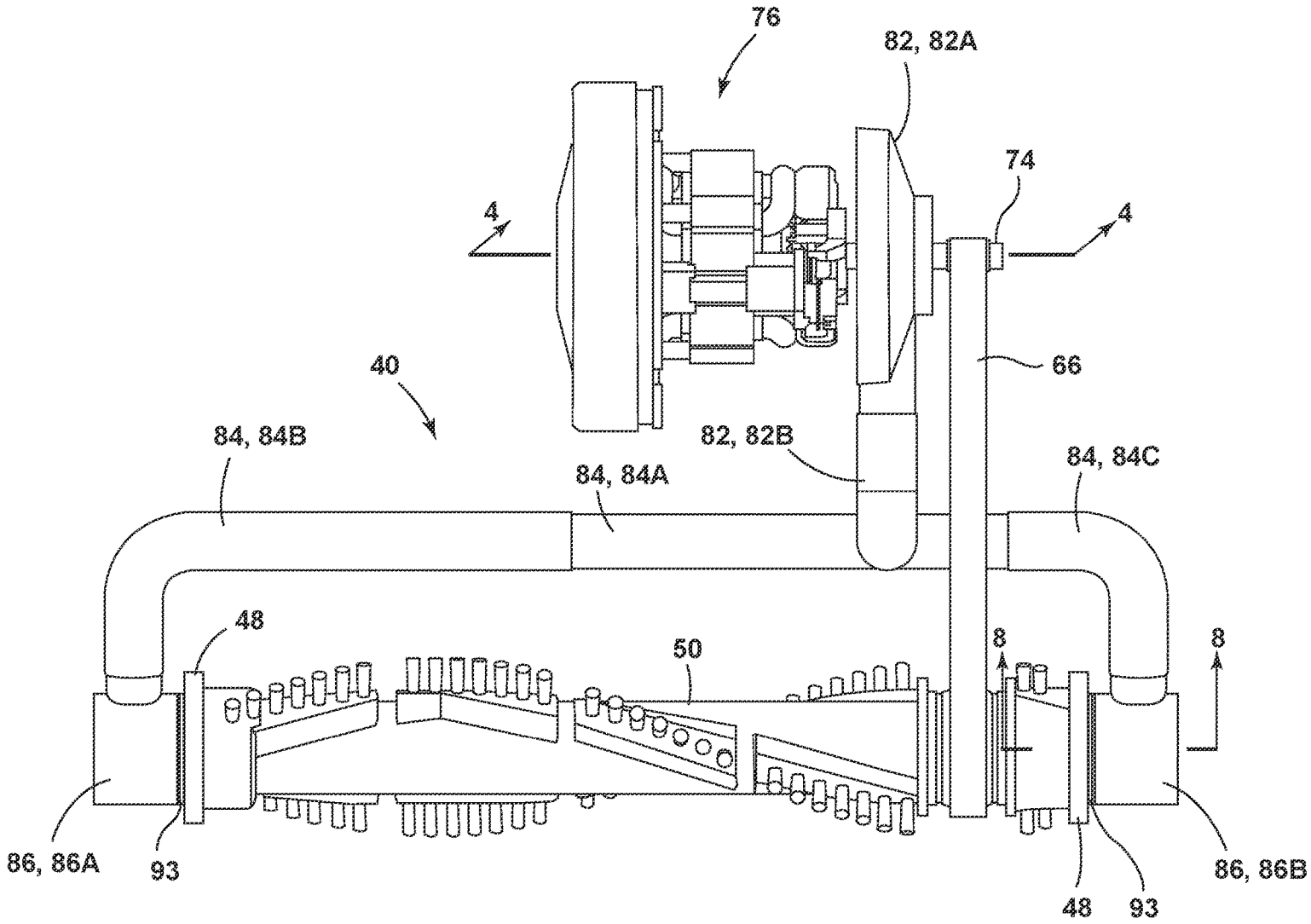
FIG. 3 is a plan view of the portion of the surface cleaner of FIG. 2 showing a specific example of the conduit system of FIG. 2 utilizing flexible tubes and tube connectors.
Figure 5:
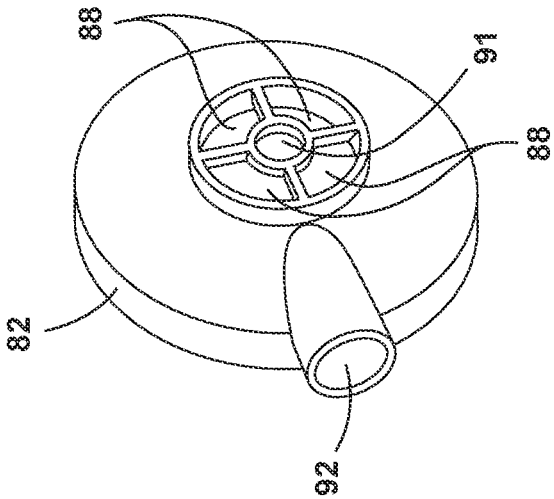
FIG. 5 is a perspective view of an impeller cover included in the conduit system of FIGS. 3-4.
Figure 4:
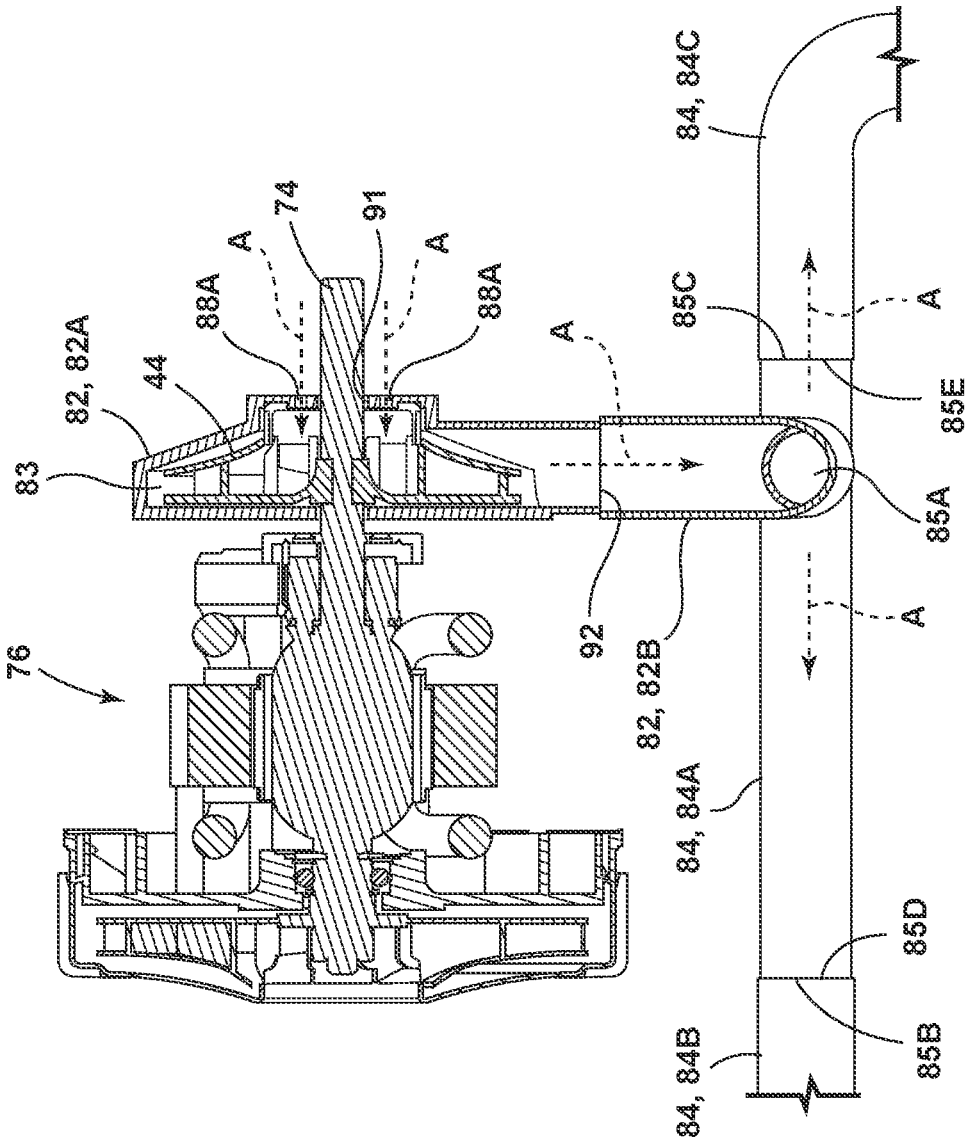
FIG. 4 is a fragmentary view of the portion of the surface cleaner of FIG. 3 in partial cross-sectional view taken at lines 4-4 in FIG. 3.

The conduit system 40 may comprise a variety of hoses, tubes, and connectors that define the various segments 82, 84, and 86. FIG. 3 is a plan view of the portion of the surface cleaner 10 of FIG. 2 showing one specific example of the conduit system 40 of FIG. 2 utilizing an impeller cover 82A and various flexible tubes and tube connectors making up the segments 82, 84, and 86. The impeller cover 82A is shaped to define a chamber 83 in which the impeller blower 44 is disposed. The chamber 83 is a portion of the air channel 42. As indicated in FIG. 5, openings in the impeller cover 82A define the air inlets 88. Additionally, a central through hole 91 receives the motor shaft 74 on which the impeller blower 44 is mounted, as best shown in FIG. 4. The belt 66 of FIGS. 1 and 2 is not shown in FIG. 4 but would be disposed around the right end of the shaft 74 in FIG. 4. By mounting the impeller motor 76 on the same motor shaft 74 as the motor 76 that drives the agitator 50 and utilizing the motor 76 to also drive the impeller blower 44, a reduction in parts and necessary packaging space may be realized in comparison to a system with a separate motor and motor shaft for the agitator 50 and for the impeller blower 44.

An outlet 92 of the impeller cover 82A is connected with a flexible tube 82B that is fit to an inlet 85A of a T-shaped connector 84A. The impeller cover 82A and flexible tube 82B serve as the first segment 42A of the conduit 40 of FIG. 2 and define a portion of the air channel 42 between the impeller blower 44 and the end caps 48.

Figure 6:
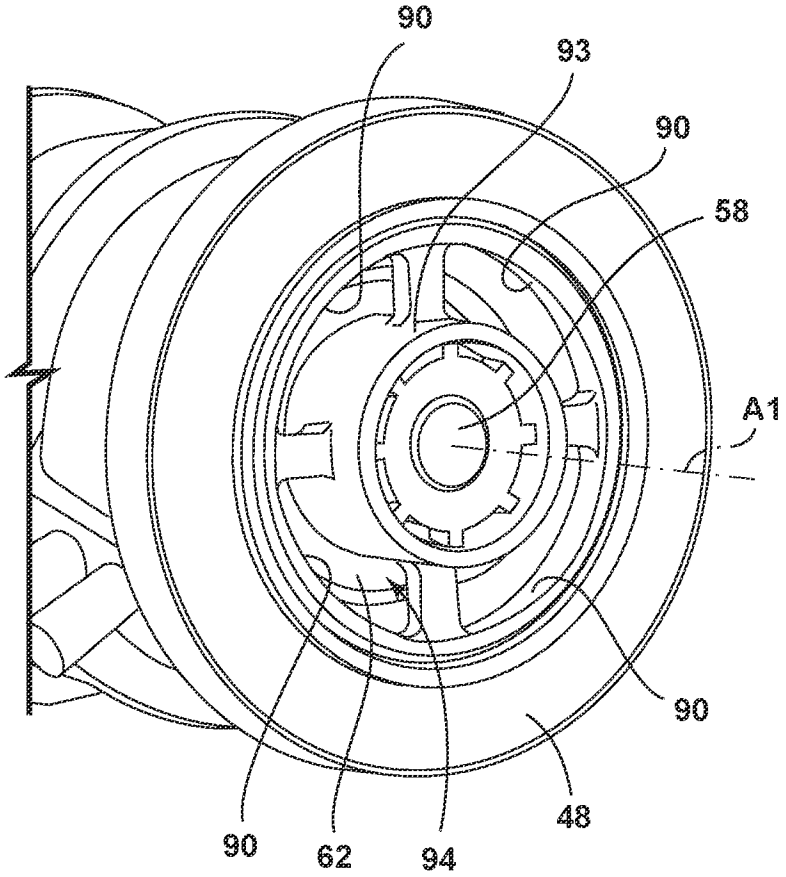
FIG. 6 is a fragmentary perspective view of a portion of the surface cleaner of FIGS. 1-4 showing one example of an end cap included in the surface cleaner.

The T-shaped connector 84A has legs with opposing outlets 85B and 85C that are fit to inlets 85D and 85E of the flexible tubes 84B and 84C, respectively. Finally, outlets of the flexible tubes 84B and 84C are fit to respective inlets of hose connectors 86A, 86B as shown in FIG. 3. The hose connectors 86A, 86B are mounted to outer hubs 93 of the end caps 48 and have an outlet at the outer hub 93. One inlet 86D and one outlet 86E are shown defined by the hose connector 86B in FIG. 8. The hose connector 86A may be a mirror image with a like inlet and outlet. FIG. 6 shows one of the end caps 48 with an outer hub 93 but with the hose connector 86B removed. FIG. 8 shows the hose connector 86B mounted to the end cap 48 via a seal 87 lodged in a groove 89 at an outer face 97 of the end cap 48. Screws or other fasteners may also be used to secure the hose connector 86B to the end cap 48 at the seal 87. The T-shaped connector 84A, the flexible tubes 84B and 84C and the hose connectors 86A, 86B define additional portions of the air channel 42 between the impeller blower 44 and the end caps 48.

Figure 7:
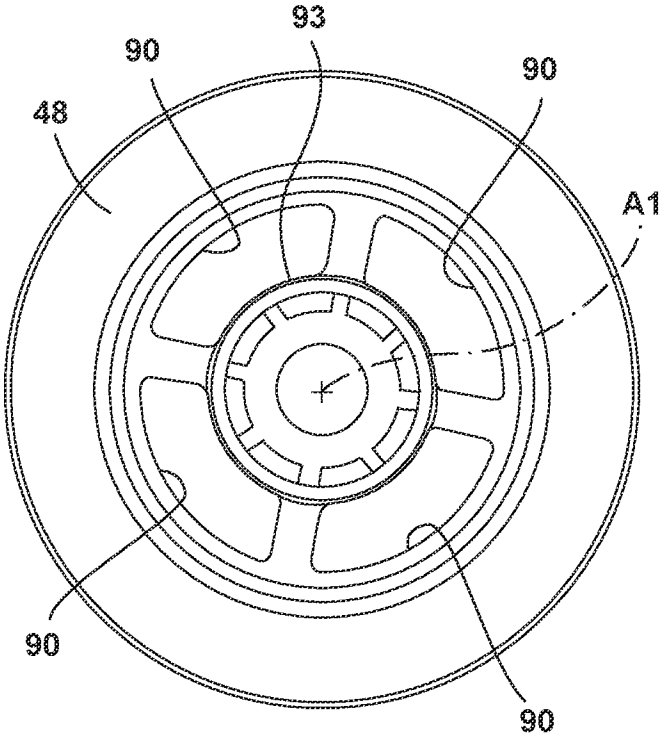
FIG. 7 is an axial end view of the end cap of FIG. 6.

Referring to FIGS. 6 and 7, the end cap 48 is shown defining multiple openings 90 extending therethrough. In other embodiments, there may be only one opening. As shown, the multiple openings 90 are spaced from one another about the axis of rotation A1. The openings 90 are shown as each having the same shape, which is a sectorial shape, and are shown spaced equidistant from one another. Alternatively, the end cap 48 could have multiple openings that are a variety of different shapes, such as circular, square, or sectorial. Additionally, the multiple openings could be spaced at a variety of different spacings from one another instead of equidistant from one another.

As best shown in FIGS. 6 and 8, the openings 90 extend parallel to the axis of rotation A1 of the agitator 50 through an axial wall 48A of the end cap 48. In this configuration, the air channel 42 (e.g., the portion exiting the end connector 86B) directs air through the openings 90 toward the bearing 62 and the axial gap 46. In other words, the blown air flows at least partially in an axial direction through the end cap 48 and is directed at least partially at an axial end face 94 of the bearing 62. By directing the air in this manner, the blown air may be more effective at blowing hair and other collected debris out of the axial gap 46 and preventing it from lodging in or around the end cap 48 and bearing 62.

After being blown into the axial gap 46, the air may exit through a gap 95 between the outer perimeter 98 of the bearing holder 64 and the end cap 48. The end cap 48 has a larger diameter than the annular bearing holder 64 and a larger diameter than the agitator 50, creating the annular gap 95. Stated differently, the gap 95 extends further axially outward than the outer perimeter 98 and further axially outward than an exterior surface 99 of the agitator 50 adjacent to the gap 95 so that air may exit from the gap 95.

Figure 9:
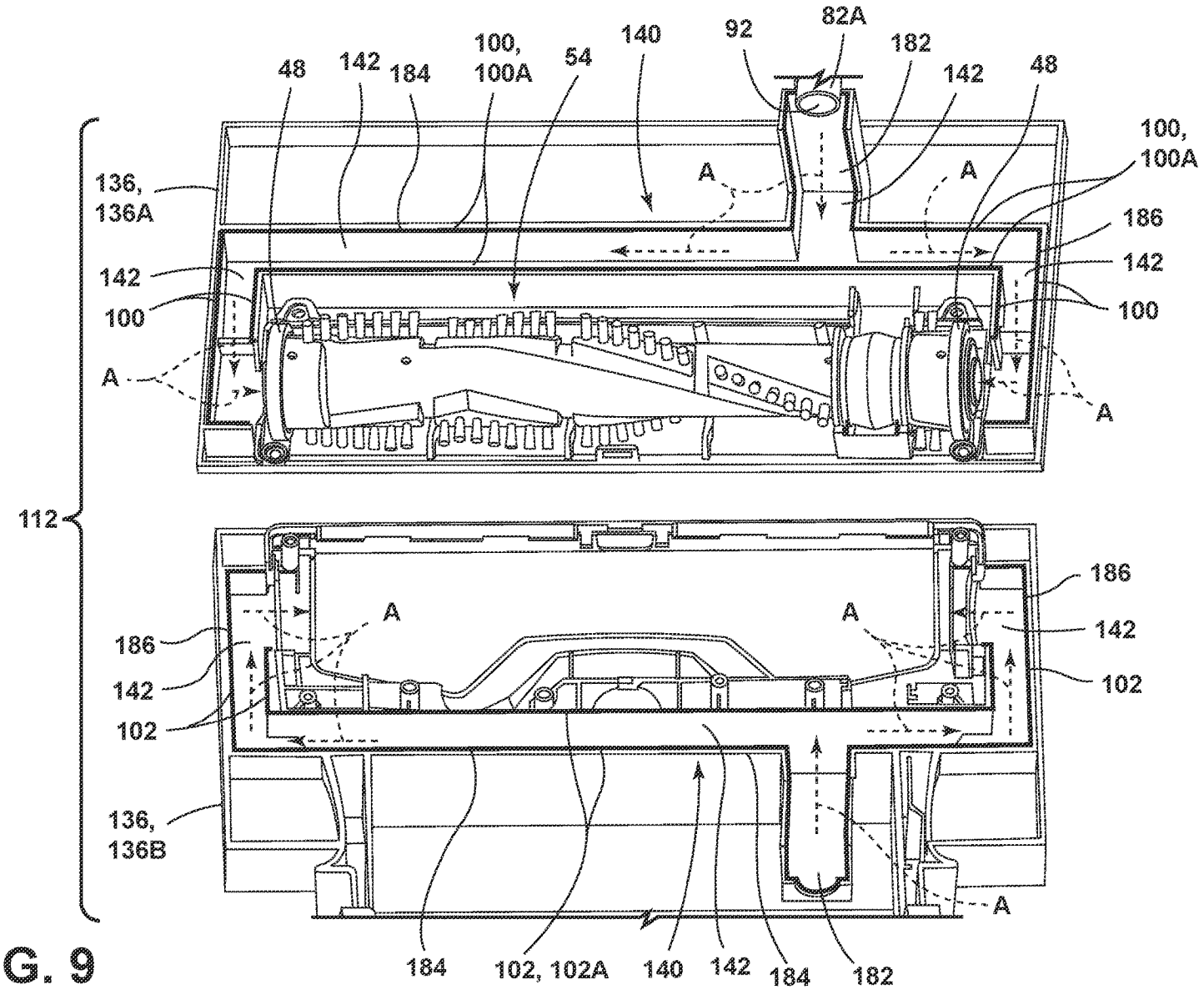
FIG. 9 is an exploded view of an alternative base for the surface cleaner of FIG. 1 showing an upper cover disassembled from a lower cover.

FIG. 9 is an exploded view of an alternative base 112 for the surface cleaner 10 of FIG. 1 that can be used in place of the base 12. The base 112 includes a base housing assembly 136 that includes a first housing member 136A and a second housing member 136B. The first housing member 136A and the second housing member 136B may also be referred to as an upper housing portion and a lower housing portion, or as an upper cover and a lower cover, respectively. The base housing assembly 136 is shown disassembled in FIG. 9 with the upper housing portion 136A shown from a bottom view and the lower housing portion shown from a top view. The upper housing portion 136A supports the agitator assembly 54 by interfitting with the end caps 48, for example.

Figure 10:
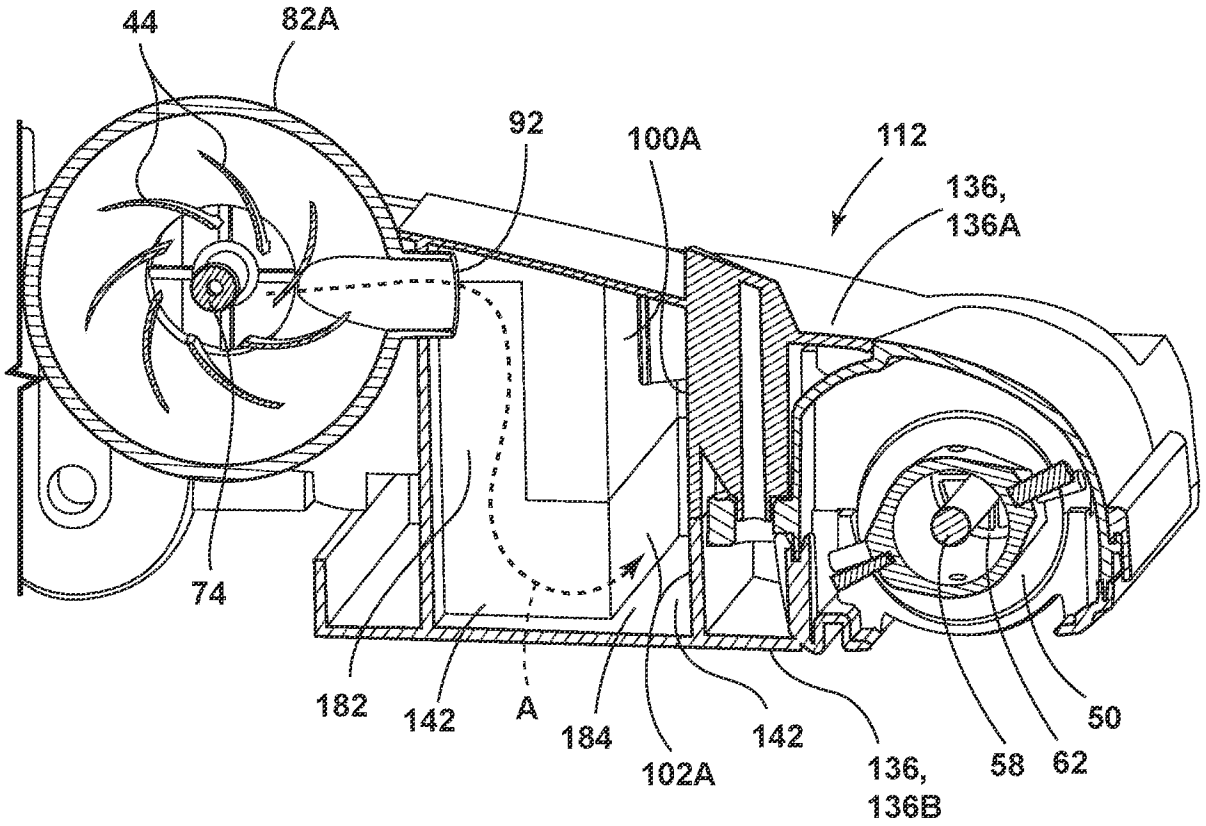
FIG. 10 is a fragmentary cross-sectional view of a surface cleaner that includes the base of FIG. 9 showing the upper cover assembled with the lower cover.

The upper housing portion 136A and lower housing portion 136B are shown assembled in FIG. 10. FIG. 10 is a fragmentary cross-sectional view taken through the outlet 92 of the impeller cover 82A perpendicular to the motor shaft 74. As is evident in FIG. 10, the first housing member 136A and the second housing member 136B interfit with one another to together form a conduit system 140 and at least a portion of an air channel 142 of the conduit system 140 that directs air blown by the impeller blower 44 into the axial gap between the end cap 48 and the bearing 62 at each end of the agitator 50. The bearing 62, bearing holder 64, the axial gap 46, and the end cap 48 are as shown in the embodiment of FIG. 2, for example.

The conduit system 140 may include a first segment 182, adjacent the outlet 92 of the impeller blower 44, a second segment 184 extending from the first segment toward opposite ends of the agitator assembly 54, and end segments 186 connecting the second segment 184 to the end caps 48. The second segment 184 is shown extending generally parallel with the axis of rotation A1. Air flow through the air channel 142 of the conduit system 140 is indicated by arrows A, beginning with air at one or more inlets 88 in the impeller cover 82A (discussed in more detail with respect to FIGS. 4 and 5) pulled in by the impeller blower 44 that is in turn blown by the impeller blower 44 through the second and third segments 184, 186 through one or more openings 90 in each of the end caps 48 (as discussed with respect to FIGS. 6 and 7).

More specifically, the first housing member 136A includes a first set of ribs 100 that form a portion of the air channel 142 and the second housing member 136B includes a second set of ribs 102 that form another portion of the air channel 142. For example, the first set of ribs 100 includes a pair of ribs 100A spaced apart from one another, such as parallel to one another, and the second set of ribs 102 includes a pair of ribs 102A spaced apart from one another, such as parallel with one another. As such, the first pair of ribs 100A forms a portion of sidewalls of the air channel 142. The second pair of ribs 102A forms another portion of side walls of the air channel 142. As indicated in FIG. 10, the first pair of ribs 100A interfits with the second pair of ribs 102A when the first housing member 136A is interfit with the second housing member 136B to together form the side walls of the portion of the air channel 142 such that the air channel 142 is bounded by the first housing member 136A, the second housing member 136B, the first set of ribs 100 and the second set of ribs 102.

Figure 11:
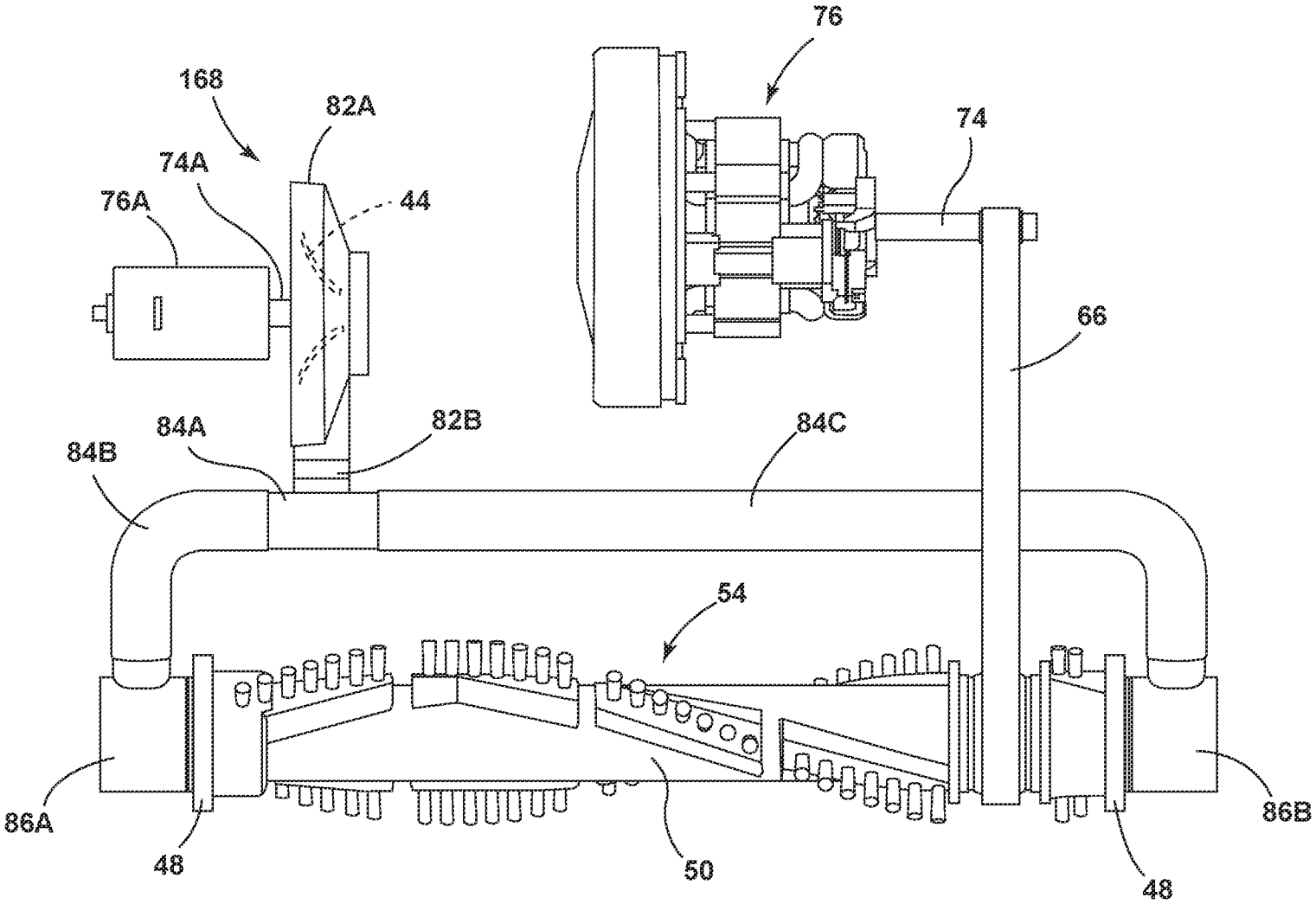
FIG. 11 is a plan view of a portion of the surface cleaner of FIG. 1 showing an alternative example including separate motors for driving the impeller and the agitator.

FIG. 11 is a plan view of a portion of the surface cleaner 10 of FIG. 1 showing an alternative example of a drive assembly 168 including separate motors 76, 76A for driving the agitator system 54 and the impeller blower 44, respectively. A motor 76A drives the impeller blower 44 and is referred to as a first motor. The first motor 76A has a first motor shaft 74A spaced apart from and not drivingly connected to the agitator 50. The impeller blower 44 is mounted on the first motor shaft 74A. The motor 76 is referred to as second motor and the motor shaft 74 on which it is mounted is referred to as a second motor shaft. As discussed with respect to FIG. 2, the second motor 76 is spaced apart from the agitator 50 and the drive belt 66 operatively connects the second motor shaft 74 and the agitator 50 to rotatably drive the agitator 50 via the drive belt 66. The components are otherwise the same as described with respect to the example of FIGS. 2-8. The legs of the connector 84A and the flexible tubes 84B, 84C, and 82B are shown as having different lengths than in FIG. 3 but are otherwise the same. Such an implementation including two motors 76, 76A on different motor shafts 74, 74A enables the impeller blower 44 to be rotated at a different speed than the agitator 50. Additionally, the first motor 76A may be controlled separately from the second motor 76 such that it need not necessarily be powered to drive the impeller blower 44 at all times that the second motor 76 is rotatably driving the agitator 50. For example, the impeller blower 44 might be pulsed to blow air into the axial gap 46 at only discreet time intervals while the second motor 76 is continuously driving the agitator 50.

Figure 12:
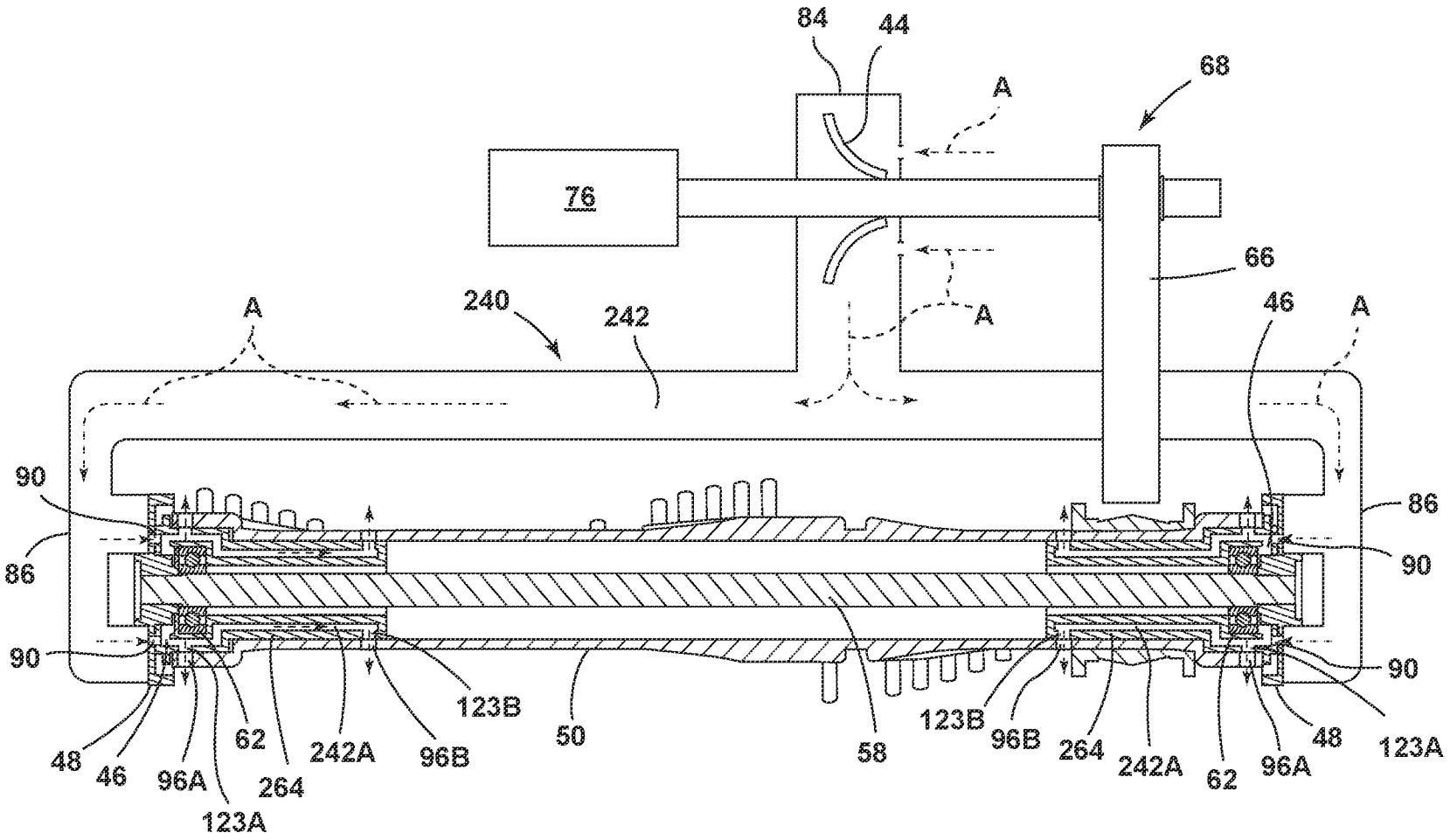
FIG. 12 is a plan view in partial cross-section of a portion of the surface cleaner of FIG. 1 showing an alternative example of a conduit system defining an air channel directing air blown by an impeller blower into an axial gap between an end cap and an agitator.

FIG. 12 is a plan view of a portion of the surface cleaner of FIG. 1 showing an alternative example of a conduit system 240 defining an air channel 242 directing air blown by the impeller blower 44 into the axial gap 46 between the end cap 48 and the agitator 50. The example shown in FIG. 12 is alike in all aspects to that shown in FIGS. 2-8 except that a bearing holder 264 is used in place of the bearing holder 64 and forms a portion 242A of the air channel 242 (referred to as an air channel extension 242A), and openings 96A, 96B are provided in the agitator 50 serving as outlets of the portion of the air channel 242. The air channel 242 is otherwise the same as the air channel 42 described with respect to FIGS. 2-8.

Figure 13:
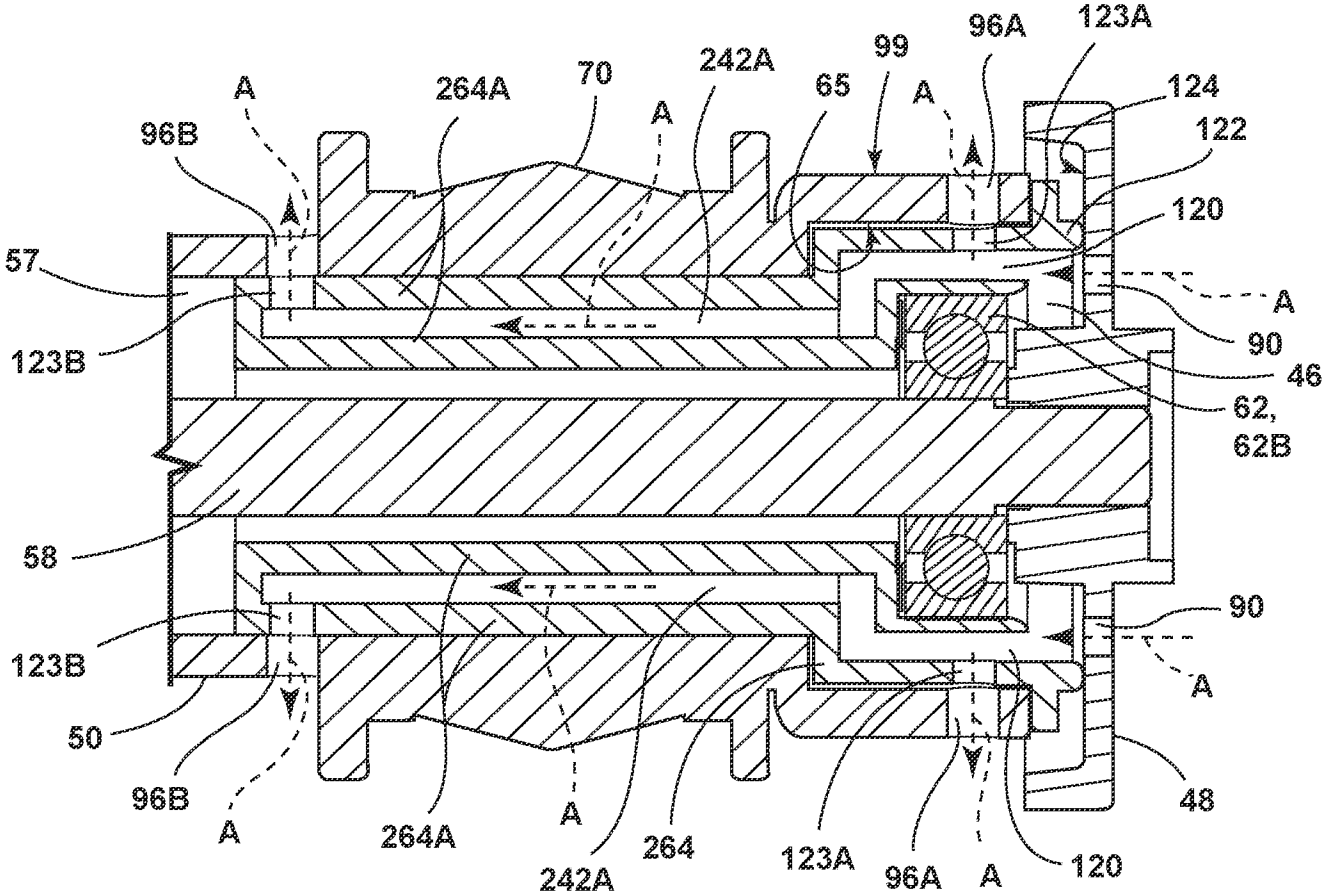
FIG. 13 is a fragmentary view of a portion of the surface cleaner of FIG. 12.

With reference to FIG. 13, the bearing holder 264 surrounds the outer race 62B of the bearing 62 and is disposed between the outer race 62B and the inner surface 65 of the agitator 50. The bearing holder 264 includes an annular extension 264A extending axially within the center cavity 57 of the agitator 50 away from the end cap 48 and the bearing 62 such that it is elongated in the axial direction in comparison the bearing holder 64 and defines the air channel extension 242A. There are two bearing holders 264 on each end of the agitator 50. The description of the bearing holder 264 in FIG. 13 applies equally to the bearing holder 264 at the opposite end of the agitator 50. The agitator 50 defines at least two openings 96A and 96B at each end that extend from the inner surface 65 to the exterior surface 99 of the agitator 50. The opening 96A is referred to herein as a first opening and the opening 96B is referred to herein as a second opening. In fact, the agitator 50 may define multiple openings 96A spaced about the circumference of the agitator 50 at the same axial location (two shown in the cross-section of FIG. 13) and multiple spaced openings 96B spaced about the circumference of the agitator 50 at the same axial location (two shown in the cross-section of FIG. 13). The agitator 50 has like openings 96A, 96B at the opposite end of the agitator 50 adjacent to the other bearing holder 264.

The bearing holder 264 defines an inlet 120 to the air channel extension 242A at the axial gap 46. The inlet 120 of the bearing holder 264 is disposed perpendicular to axially-spaced outlets 123A, 123B of the bearing holder 264. More specifically, the bearing holder 264 defines two axially-spaced outlets 123A and 123B that are axially-spaced by the same distance as the axial spacing between the openings 96A, 96B of the agitator 50 and in fluid communication with the openings 96A, 96B in the agitator 50. The outlet 123A is referred to herein as a first outlet and the outlet 123B is referred to herein as a second outlet.

The blown air that enters the axial gap 46 is further directed to continue past the axial gap 46 through the inlet 120 and is expelled from the air channel extension 242A at the outlets 123A, 123B and then out through the openings 96A, 96B in the agitator 50. Similarly to the openings 96A, 96B of the agitator 50, the bearing holder 264 may define multiple outlets 123A spaced about the circumference of the annular extension 264A at the same axial location (two shown in the cross-section of FIG. 13) and multiple spaced outlets 123B spaced about the circumference of the annular extension 264A at the same axial location (two shown in the cross-section of FIG. 13). Additionally, an axial end 122 of the bearing holder 264 sealingly engages an axial inner face 124 of the end cap 48 so that the end cap 48 does not provide a gap 95 through which the blown air can exit as does the bearing holder 64 described with respect to the configuration of FIG. 8.

Figure 14:
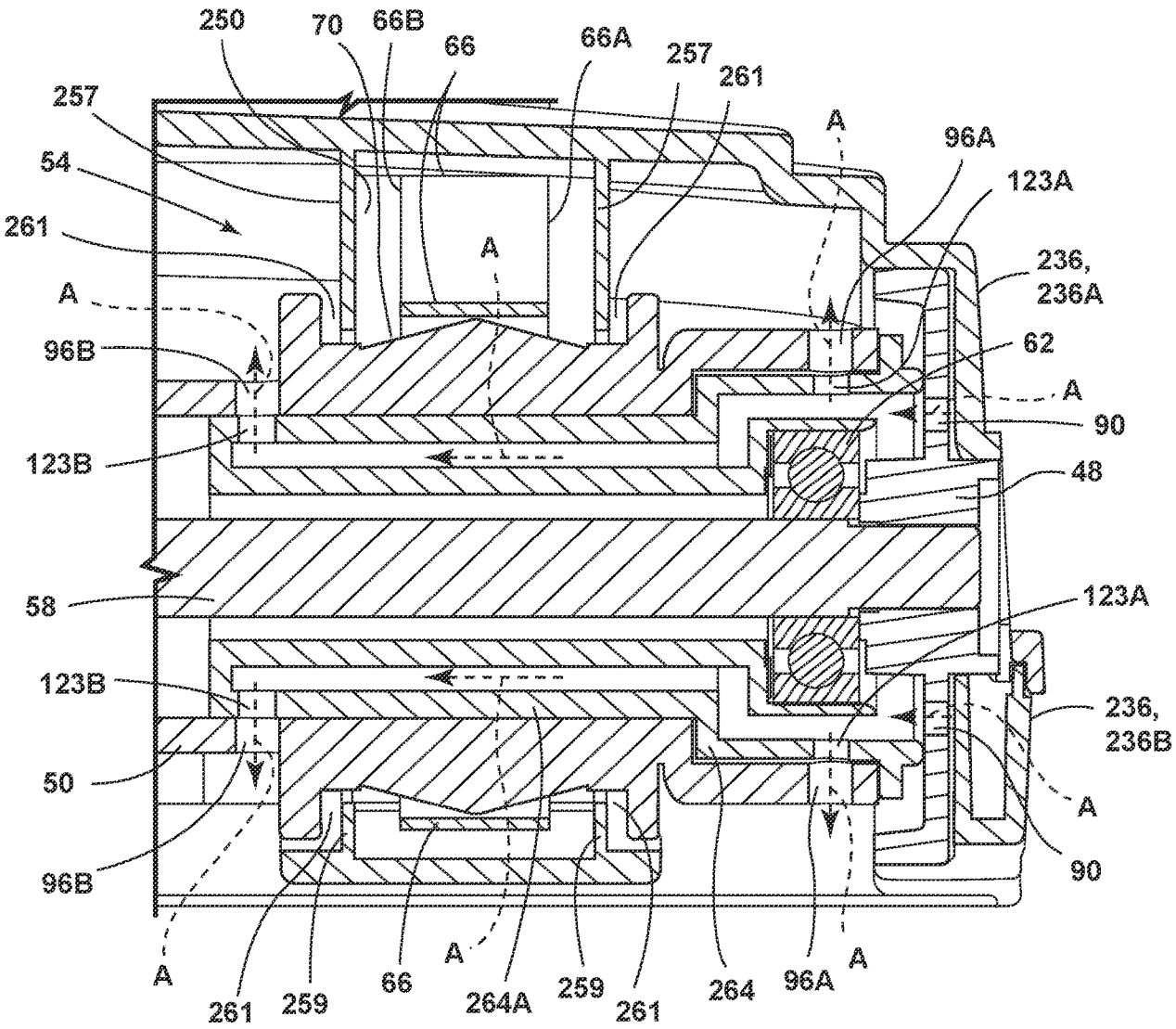
FIG. 14 is a fragmentary view of the portion of the base of the surface cleaner of FIG. 13 including a base housing assembly.

As indicated in FIGS. 13 and 14, the axially spacing of the outlets 123A, 123B and of the openings 96A, 96B is such that the pulley 70 at which the drive belt 66 engages the agitator 50 is disposed axially between the first outlet 123A and the second outlet 123B and the respective openings 96A, 96B aligned therewith. Stated differently, the first outlet 123A and the first opening 96A may be disposed axially adjacent a first edge 66A of the drive belt 66. The second outlet 123B and the second opening 96B may be disposed axially adjacent to a second edge 66B of the drive belt 66. In this manner, in addition to inhibiting debris in the axial gap 46 between the end of the agitator 50 and the bearing 264, the blown air is directed at either side of the drive belt 66 through the first and second openings 96A, 96B in the agitator 50.

As shown in FIG. 14, a base housing assembly 236 may be used that includes a first housing member 236A (also referred to as an upper housing portion or upper cover) and a second housing member 236B (also referred to as a lower housing portion or lower cover) that interfits with the first housing member 236A to define the agitator chamber 54. The upper housing portion 236A includes a window 250 through which the belt 66 extends to engage the pulley 70. In order to protect the belt 66 as well as to help to further enclose the agitator chamber 54, the first housing member 236A includes ribs 257 extending inward toward the agitator 50 adjacent to side edges 66A, 66B of the belt 66 at the window 250. The lower housing portion 236B includes similar ribs 259 spaced adjacent to the side edges 66A, 66B of the belt 66. By directing the blown air outward through the outlets 96A, 96B in a radial direction (e.g., a direction perpendicular to the axis of rotation of the agitator 50), the air blown through the first and second outlets 96A, 96B may help to prevent hair and debris from entering small gaps 261 between the ribs 259 and the pulley 70 and between the ribs 259 and the pulley 70 and being entangled with the drive belt 66.

Figure 15:
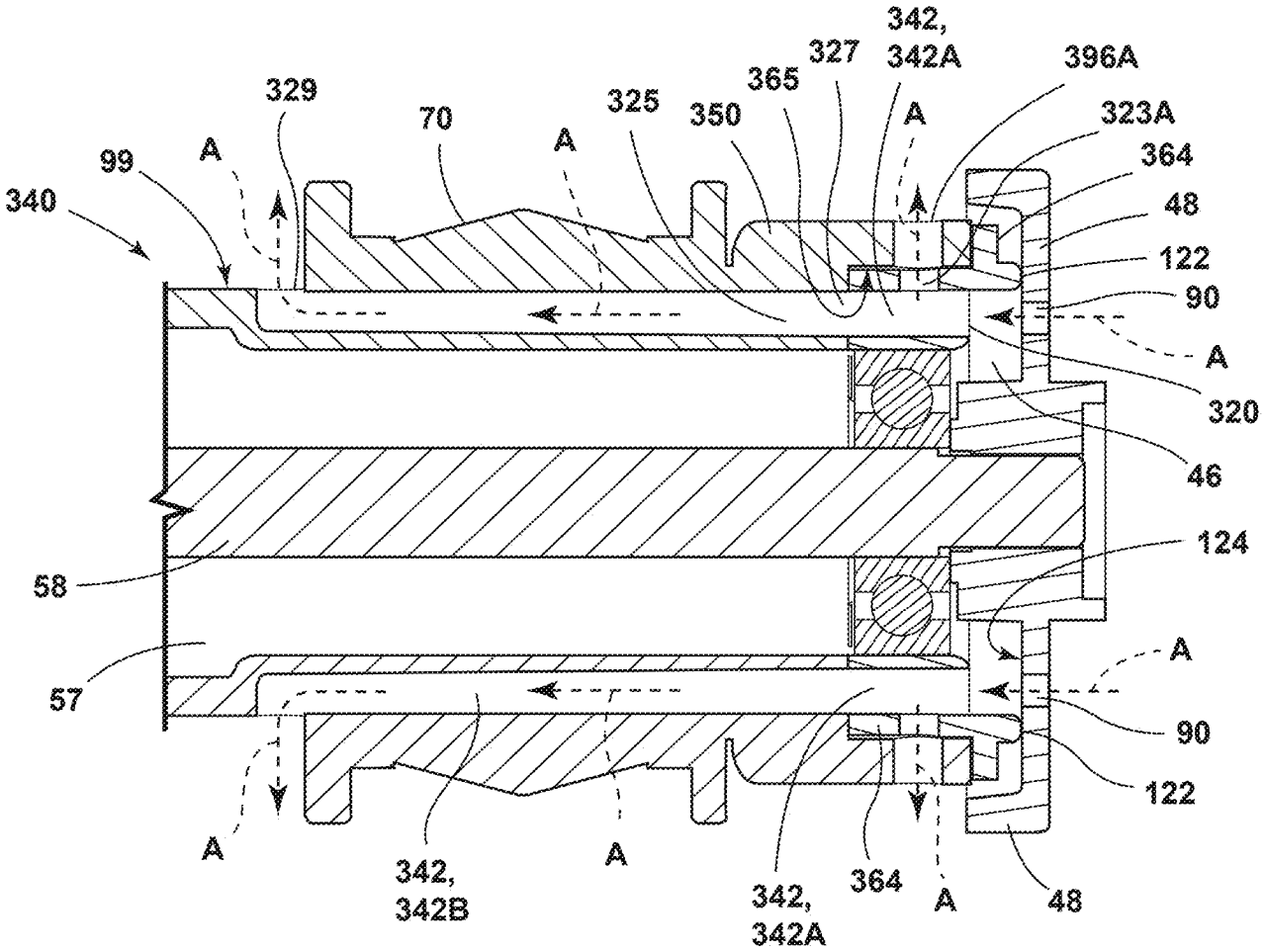
FIG. 15 is a fragmentary view of a portion of the surface cleaner of FIG. 1 showing an alternative example of a conduit system defining an air channel directing air blown by an impeller blower into an axial gap between an end cap and an agitator.

FIG. 15 is a fragmentary view of a portion of the surface cleaner 10 of FIG. 1 showing an alternative example of a conduit system 340 defining an air channel 342 directing air blown by the impeller blower 44 of FIG. 1 into the axial gap 46 between the end cap 48 and an agitator 350. The agitator 350 is configured like the agitator 50 except that it defines an axially-extending portion 342B of the air channel 342 to help direct the blown air. The axial extending portions 342A and 342B are together referred to as an air channel extension 342A, 342B. The axial-extending portion 342A is referred to herein as a first portion of the air channel extension 342A, 342B and the axially-extending portion 342B is referred to herein as a second portion of the air channel extension 342A, 342B. The axially-extending portion 342B is similar to the axially-extending air channel extension 242A of the bearing holder 264 of FIG. 14, except that it is defined by an annular portion of the agitator 350 rather than by a bearing holder. Specifically, the conduit system 340 of FIG. 15 includes a bearing holder 364 that surrounds the outer race 62B of the bearing 62 and is disposed between the outer race 62B and an inner surface 365 of the agitator 350. Similar to the bearing holder 264, the bearing holder 364 has an end 122 that sealingly engages the axial inner face 124 of the end cap 48 so that the end cap 48 does not provide a gap 95 through which the blown air can exit as does the bearing holder 64 described with respect to the configuration of FIG. 8. By not having such a gap 95, the blown air is forced through the first and second air channel extensions 342A, 342B.

The bearing holder 364 defines the first portion 342A of the air channel extension 342A, 342B, an inlet 320 to the first portion 342A at the axial gap 46, and an outlet 325 of the first portion 342A. The agitator 350 defines the second portion 342B of the air channel extension 342A, 342B, an axial inlet opening 327 of the second portion 342B in fluid communication with the outlet 325 of the first portion 342A defined by the bearing holder 364, and an outlet 329 of the second portion 342B at the exterior surface 99 of the agitator 350. For example, the second portion 342B may extend in an axial direction away from the first portion 342A. The outlet 329 of the second portion 342B defined by the agitator 350 may be referred to herein as a first outlet and the agitator 350 may include a second outlet 396A at the exterior surface 99 of the agitator 350. The second outlet 396A is in fluid communication with the outlet 323A of the bearing holder 364. Accordingly, blown air exits through both of the outlets 329, 396A. The second portion 342B is configured so that the outlets 329, 396A are axially adjacent opposite sides of the pulley 70. The axial spacing of the outlets 329, 396A is such that the pulley 70 at which the drive belt 66 engages the agitator 350 is disposed axially between the outlets 329, 396A. Accordingly, if the base housing assembly 236 is utilized, the outlets 329, 396A will inhibit hair and debris from entering the gaps 261 as described with respect to the example of FIG. 14.

The following Clauses provide example configurations of a surface cleaner and other articles disclosed herein.

Clause 1. A surface cleaner configured for movement across a surface to be cleaned, the surface cleaner comprising: a base housing assembly defining an agitator chamber; an end cap; a bearing disposed axially adjacent to the end cap; an agitator rotatably supported on the bearing for rotation about an axis of rotation in the agitator chamber, the end cap and the agitator defining an axial gap between an axial end of the agitator and the end cap; a motor shaft spaced apart from the agitator; a drive belt operatively connecting the motor shaft and the agitator; a motor connected with the motor shaft and operable to rotatably drive the agitator via the motor shaft and drive belt; an impeller blower mounted on the motor shaft; and a conduit system at least partially defining an air channel directing air blown by the impeller blower into the axial gap.

Clause 2. The surface cleaner of clause 1, wherein: the end cap defines at least one opening extending therethrough; and the air channel directs air through the at least one opening toward the bearing and the axial gap.

Clause 3. The surface cleaner of clause 2, wherein an outlet of the at least one opening in the end cap is disposed such that the air blown into the axial gap is directed at least partially at an axial end face of the bearing.

Clause 4. The surface cleaner of clause 3, wherein the at least one opening extends parallel to the axis of rotation of the agitator through an axial wall of the end cap.

Clause 5. The surface cleaner of any of clauses 2-4, further comprising: a bearing holder surrounding an outer race of the bearing and disposed between the outer race and an inner surface of the agitator; wherein the agitator defines an opening extending from the inner surface to an exterior surface of the agitator; and wherein the bearing holder defines an air channel extension, an inlet to the air channel extension at the axial gap, and an outlet of the air channel extension in fluid communication with the opening in the agitator to expel the blown air from the gap.

Clause 6. The surface cleaner of clause 5, wherein the inlet of the bearing holder is disposed perpendicular to the outlet of the bearing holder.

Clause 7. The surface cleaner of clause 5, wherein: the outlet of the bearing holder is a first outlet and the opening in the agitator is a first opening; the bearing holder further defines a second outlet of the air channel extension; the agitator defines a second opening extending from the inner surface to the exterior surface of the agitator; the first outlet and the first opening are disposed axially adjacent a first edge of the drive belt; and the second outlet and the second opening are disposed axially adjacent a second edge of the drive belt.

Clause 8. The surface cleaner of clause 7, wherein: the bearing holder has an annular extension extending axially within a center cavity of the agitator away from the end cap and the bearing; and the annular extension defines the air channel extension.

Clause 9. The surface cleaner of any of clauses 2-4, further comprising: a bearing holder surrounding an outer race of the bearing and disposed between the outer race and an inner surface of the agitator; wherein the bearing holder defines a first air channel extension, an inlet to the first air channel extension at the axial gap, and an outlet of the first air channel extension; and wherein the agitator defines a second air channel extension, an axial inlet opening of the second air channel extension in fluid communication with the outlet of the first air channel extension defined by the bearing holder, and an outlet of the second air channel extension at an exterior surface of the agitator.

Clause 10. The surface cleaner of clause 9, wherein: the outlet of the second air channel extension defined by the agitator is a first outlet; and the agitator includes a second outlet at the exterior surface of the agitator axially-spaced from the first outlet.

Clause 11. The surface cleaner of any of clauses 1-4, wherein the base housing assembly includes a first housing member and a second housing member; and wherein the first housing member interfits with the second housing member to together form a portion of the air channel of the conduit system directing air blown by the impeller blower into the axial gap.

Clause 12. The surface cleaner of clause 11, wherein: the first housing member includes a first set of ribs and the second housing member includes a second set of ribs; and the first set of ribs interfit with the second set of ribs when the first housing member is interfit with the second housing member to define the portion of the air channel bounded by the first housing member, the second housing member, the first set of ribs, and the second set of ribs.

Clause 13. The surface cleaner of any of clauses 1-4, wherein the conduit system includes a flexible tube defining at least a portion of the air channel between the impeller blower and the end cap.

Clause 14. A surface cleaner configured for movement across a surface to be cleaned, the surface cleaner comprising: a base housing assembly defining an agitator chamber; end cap; wherein the end cap defines at least one opening extending therethrough; a bearing disposed axially adjacent to the end cap; an agitator rotatably supported on the bearing for rotation about an axis of rotation in the agitator chamber, the end cap and the agitator defining an axial gap between an axial end of the agitator and the end cap; a motor; an impeller blower operatively connected to the motor; and a conduit system at least partially defining an air channel directing air blown by the impeller blower through the at least one opening in the end cap into the axial gap; wherein the at least one opening in the end cap is configured to direct the blown air at least partially in an axial direction into the axial gap.

Clause 15. The surface cleaner of clause 14, wherein the at least one opening extends parallel to the axis of rotation of the agitator through an axial wall of the end cap.

Clause 16. The surface cleaner of clause 15, wherein the at least one opening includes multiple openings spaced from one another about the axis of rotation.

Clause 17. The surface cleaner of any of clauses 14-17, wherein the motor is a first motor mounted on a first motor shaft spaced apart from and not drivingly connected to the agitator; the surface cleaner further comprising: a second motor mounted on a second motor shaft spaced apart from the agitator; and a drive belt operatively connecting the second motor shaft and the agitator; wherein the second motor rotatably drives the agitator via the drive belt.

Clause 18. A surface cleaner configured for movement across a surface to be cleaned, the surface cleaner comprising: a base housing assembly defining an agitator chamber; an end cap; wherein the end cap defines at least one opening extending therethrough; a bearing disposed axially adjacent to the end cap; an agitator rotatably supported on the bearing for rotation about an axis of rotation in the agitator chamber, the end cap and the agitator defining an axial gap between an axial end of the agitator and the end cap; an impeller blower; a motor operatively connected to the impeller blower and operable to rotatably drive the impeller blower; a conduit system at least partially defining an air channel directing air blown by the impeller blower through the opening in the end cap into the axial gap; and a bearing holder surrounding an outer race of the bearing and disposed between the outer race and an inner surface of the agitator; wherein the conduit system defines an air channel extension extending at least partially axially within the agitator from an inlet at the axial gap to an opening extending through the agitator with an outlet at an exterior surface of the agitator.

Clause 19. The surface cleaner of clause 18, wherein the bearing holder defines at least a portion of the air channel extension and defines the inlet at the axial gap.

Clause 20. The surface cleaner of clause 19, wherein: the agitator defines an additional portion of the air channel extension including an axial inlet opening in fluid communication with an outlet of the portion of the air channel extension defined by the bearing holder; and the additional portion of the air channel extension extends from the axial inlet opening to the opening extending through the agitator.

To assist and clarify the description of various embodiments, various terms are defined herein. Unless otherwise indicated, the following definitions apply throughout this specification (including the claims). Additionally, all references referred to are incorporated herein in their entirety.

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A surface cleaner configured for movement across a surface to be cleaned, the surface cleaner comprising:

a base housing assembly defining an agitator chamber;

an end cap;

a bearing disposed axially adjacent to the end cap;

an agitator rotatably supported on the bearing for rotation about an axis of rotation in the agitator chamber, the end cap and the agitator defining an axial gap between an axial end of the agitator and the end cap;

a motor shaft spaced apart from the agitator;

a drive belt operatively connecting the motor shaft and the agitator;

a motor connected with the motor shaft and operable to rotatably drive the agitator via the motor shaft and drive belt;

an impeller blower mounted on the motor shaft; and a conduit system at least partially defining an air channel directing air blown by the impeller blower into the axial gap.

2. The surface cleaner of claim 1, wherein:

the end cap defines at least one opening extending therethrough; and the air channel directs air through the at least one opening toward the bearing and the axial gap.

3. The surface cleaner of claim 2, wherein the axial gap includes a first portion radially inward relative to the axis of rotation from the at least one opening and a second portion located radially outward relative to the axis of rotation.

4. The surface cleaner of claim 3, wherein the axial gap is at least partially defined by the bearing.

5. The surface cleaner of claim 2, wherein an outlet of the at least one opening in the end cap is disposed such that the air blown into the axial gap is directed at least partially at an axial end face of the bearing.

6. The surface cleaner of claim 5, wherein the at least one opening extends parallel to the axis of rotation of the agitator through an axial wall of the end cap.

7. The surface cleaner of claim 6, wherein the agitator includes a bearing holder configured to rotate with an outer race of the bearing and the bearing holder at least partially defines the axial gap with the end cap.

8. The surface cleaner of claim 6, further comprising:

a radial gap at least partially defined by the end cap and the agitator, wherein the radial gap is fluidly downstream from the axial gap.

9. The surface cleaner of claim 8, wherein the radial gap includes an outlet configured to direct air from the air channel in an axial direction relative to the axis of rotation and towards the agitator.

10. The surface cleaner of claim 9, wherein the outlet of the radial gap is located radially outer relative to the axis of rotation and the at least one opening.

11. The surface cleaner of claim 1, wherein the conduit system includes a flexible tube defining at least a portion of the air channel between the impeller blower and the end cap.

12. The surface cleaner of claim 11, wherein the conduit system includes a first branch defining at least a portion of the air channel between the impeller blower and the end cap and the conduit system includes a second branch defining at least a portion of the air channel between the impeller blower and a second axial gap with the second axial gap located between a second end cap and a second axial end of the agitator.

13. A surface cleaner configured for movement across a surface to be cleaned, the surface cleaner comprising:

a base housing assembly defining an agitator chamber;

an end cap; wherein the end cap defines at least one opening extending therethrough;

a bearing disposed axially adjacent to the end cap;

an agitator rotatably supported on the bearing for rotation about an axis of rotation in the agitator chamber, the end cap and the agitator defining an axial gap between an axial end of the agitator and the end cap;

a motor shaft spaced apart from the agitator;

a motor connected to the motor shaft;

an impeller blower operatively connected to the motor and mounted on the motor shaft; and a conduit system at least partially defining an air channel directing air blown by the impeller blower through the at least one opening in the end cap into the axial gap; wherein the at least one opening in the end cap is configured to direct the blown air at least partially in an axial direction into the axial gap.

14. The surface cleaner of claim 13, wherein the at least one opening extends parallel to the axis of rotation of the agitator through an axial wall of the end cap.

15. The surface cleaner of claim 14, wherein the at least one opening includes multiple openings spaced from one another about the axis of rotation.

16. The surface cleaner of claim 14, wherein the agitator includes a bearing holder configured to rotate with an outer race of the bearing and the bearing holder at least partially defines the axial gap with the end cap.

17. The surface cleaner of claim 14, further comprising:

a radial gap at least partially defined by the end cap and the agitator, wherein the radial gap is fluidly downstream from the axial gap.

18. The surface cleaner of claim 17, wherein the radial gap includes an outlet configured to direct air from the air channel in the axial direction relative to the axis of rotation and towards the agitator.

19. The surface cleaner of claim 18, wherein the outlet of the radial gap is located radially outer relative to the axis of rotation and the at least one opening.

20. The surface cleaner of claim 13, wherein the axial gap includes a first portion radially inward relative to the axis of rotation from the at least one opening and a second portion located radially outward relative to the axis of rotation and the axial gap is at least partially defined by the bearing.

* * * * *